United States Patent [19]

Margaroli et al.

[11] Patent Number: 4,560,225

[45] Date of Patent: Dec. 24, 1985

[54] ELECTRICAL CONNECTOR FOR FLAT CABLES AND ASSEMBLY THEREOF WITH A FLAT CABLE

[75] Inventors: Giovanni Margaroli, Arese; Mario Gandini, Milan, both of Italy

[73] Assignee: Servocavi S.p.A., Milan, Italy

[21] Appl. No.: 610,107

[22] Filed: May 14, 1984

[30] Foreign Application Priority Data

May 24, 1983 [IT] Italy ..... 21 240 A/83

[51] Int. Cl.[4] ..... H01R

[52] U.S. Cl. ..... 339/97 C; 339/276 T

[58] Field of Search ..... 339/97 R, 97 C, 97 P, 339/95 R, 276 T, 17 F

[56] References Cited

U.S. PATENT DOCUMENTS

| | | | |
|---|---|---|---|
| 3,728,473 | 4/1973 | Kuo | 339/97 C |
| 4,256,359 | 3/1981 | Storck | 339/97 C |
| 4,263,474 | 4/1981 | Tennant | 339/97 C |

*Primary Examiner*—Gil Weidenfeld
*Assistant Examiner*—Paula Austin
*Attorney, Agent, or Firm*—Brooks, Haidt, Haffner & Delahunty

[57] ABSTRACT

An electrical connector for flat cables having an element which can be connected to a flat cable so as to effect an electrical connection between a flat cable on the conductor of another cable.

15 Claims, 5 Drawing Figures

ELECTRICAL CONNECTOR FOR FLAT CABLES AND ASSEMBLY THEREOF WITH A FLAT CABLE

The present invention refers to an electrical connector for flat cables and particularly to an element which can be connected to a flat cable so as to effect an electrical connection between the flat cable and the conductor of another cable.

Further, the present invention refers to an electrical connection comprising a flat cable to which a connector according to the invention is connected.

Many connectors for flat cables are known, i.e. connectors for cables the conductor of which is constituted by a metal tape usually covered with a layer of insulating material, for instance, a plastic material.

Many of the known connectors for flat cables are of the type which comprises a metallic plate, which can be folded along a line so as to provide two arms having means for providing a mechanical and electrical connection between said arms and a flat cable interposed between the arms.

The known connectors of such type for flat cables differ from one another depending on the particular means used for effecting the mechanical and electrical connection with the flat cable.

Such known connectors for flat cables can be divided into three different groups on the basis of the means used to make the mechanical and the electrical connection with the flat cable.

A first group of such known connectors for flat cables employs, as means for making a mechanical and electrical connection with a flat cable, a plurality of tangs projecting from the facing surfaces of the two arms of the connector so that said tangs perforate the insulation of the flat cable and contact the conductor of the cable. See, for example, U.S. Pat. No. 3,541,226.

The connectors for flat cables belonging to this first group differ from one another in the shape of the tangs and in the way by which the tangs are disposed on the surfaces of the arms of the connectors.

A second group of such known connectors for flat cables, to effect the mechanical and electrical connection with a flat cable, employs elements projecting from one of the connector arms. Said elements perforate the conductor of the flat cable and, in some cases, they anchor to the other connector arm. See, for example, U.S. Pat. No. 3,880,488.

In particular, in the second group, the elements projecting from one of the connector arms are constituted by tongues and the like which after having perforated the conductor of the flat cable, pass across openings provided in the other arm and fold over this latter.

The third group of such known connectors for flat cables comprises those conductors which, as means for effecting the mechanical and electrical connection with a cable, employs a complementary configuration of the facing surfaces of the arms between which the flat cable is interposed and folded to follow the configuration of the surfaces of the arms. During the folding operation of the flat cable, ruptures occur at points of the cable insulation with consequent contact between the conductor of this latter and the arms.

The features which are required for connectors for flat cables are the following:

a. an effective mechanical connection between the connector and a flat cable which lasts for a substantial period of time;

b. an electrical connection between the connector and the conductor of the flat cable which must be very good for a substantial period of time; and c. the encumbrance presented by the connection between connector and flat cable must be as small as possible since the flat cables are usually used in consumer electrical systems to form a network for the distribution of electric power, a telephone network or a network for the transmission of data, said networks being arranged between the floor and a covering surface of textile material for the floor, such as, for instance, fitted carpet and the like.

All such known connectors previously described are not able to guarantee the simultaneous presence of all the features described hereinbefore at an optimum degree.

In fact, the known connectors belonging to the first group, although presenting a small encumbrance, are not able to give a good mechanical connection between connector and flat cable since said connection takes place at the cable insulation, which, as previously stated, is of plastic material or the like which has unsatisfactory mechanical resistance characteristics.

Moreover, the electrical connection obtained by means of the connectors of the first group is unsatisfactory due to the great deformability of the tangs projecting from the arms of the connector, and because said electrical connection deteriorates with time as a result of the heating and cooling thermal cycles of the cable connector which cannot be avoided during the working of the cable. In fact, the thermal cycles cause fatigue stresses in the tangs which tend to get deformed, making their contact with the cable conductor worse.

The known connectors of the second group although assuring a very good mechanical connection between the connector and the flat cable which endures and presenting a small encumbrance of the connection, are not able to provide a good electrical connection since the contact between the connector and the conductor of the flat cable corresponds only to the cable thickness and consequently, the surface where the contact takes place is obviously very small.

In order to improve the electrical connection of the connectors belonging to the second group, connectors are known which associate, with the connecting means provided in said second group, the connecting means forming part of the first group of connectors. In this way, the electrical connection between the connectors and the flat cables is improved in part, but said electrical connection does not remain constant with time for the reasons previously stated with respect to the connectors of the first group.

Also, the connectors of the third group do not have the features required for a connector to an optimum degree. In fact, the connectors of the third group, although having a good mechanical anchoring, present a substantial encumbrance at the connection, and the electrical connection obtained with said connectors is not sufficient since the direct contact between the connector and the cable conductor takes place only where, during the bending of the cable, a rupture of the cable insulation has occurred. Therefore, the electrical connection takes place between surfaces of small area.

The present invention aims at providing a connector and an electrical connection between a connector and a flat cable, which permit obtainining with a small encumbrance for the connection, the certainty of a very good, lasting electrical contact between the connection and the flat cable in conjunction with a very good mechanical connection.

The principal object of the present invention is a connector for flat cables comprising a metallic material plate which can be folded along an intermediate line so as to provide a first arm and a second arm, means provided on the arms adapted to couple with each other and to a flat cable interposed between the arms to effect, at the same time, a mechanical connection and an electrical connection with the cable conductor, characterized by the fact that said means comprises:

at least a first, hollow, cylindrical member which is radially deformable and which projects from a surface of the first arm facing toward the second arm, the axis of said first, hollow, cylindrical member being perpendicular to said surface of said first arm and the whole contour of the distal end of the first, hollow, cylindrical, member, i.e. farthest from the first arm lying in a single plane;

at least a second, hollow, cylindrical member, which is radially deformable and which projects from the surface of the second arm facing toward the first arm, the axis of the second, cylindrical member being perpendicular to said second arm and the whole contour of the distal end of the second, hollow, cylindrical member, i.e. farthest from the second arm, lying in a single plane; and said first cylindrical member being of a size which permits it to extend into said second cylindrical member, the difference between the inner radial dimensions of the second cylindrical member and the outer radial dimensions of the first cylindrical member being not less than $\frac{1}{3}$ of the thickness of the flat cable conductor to be interposed between said first and second arm.

Preferably the first, hollow cylindrical member has an axial height greater than the axial height of the second, hollow cylindrical member.

As regards the second, hollow, cylindrical member, it can have its end farthest from the second arm flare toward the outside.

Another object of the present invention is an electrical connection comprising a flat cable constituted by at least a metallic tape covered with a layer of insulating material and a connector in the form of a metallic material plate which can be folded along an intermediate line so as to provide a first arm and a second arm provided with means adapted to couple with each other and with the flat cable interposed between the arms, characterized by the fact that said means comprises:

at least a first, hollow, cylindrical member, radially deformable, which projects from a surface of the first arm facing toward the second arm, the axis of said first member being perpendicular to said surface of said first arm;

at least a second, hollow, cylindrical member, radially deformable, which projects from the surface of the second arm facing toward the first arm, the axis of said second member being perpendicular to said surface of the second arm, said second hollow cylindrical member being dimensioned so as to receive the first, hollow, cylindrical member; and the coupling between said hollow, cylindrical members and the flat cable taking place with the formation of an embossing in the flat cable and a removal of the flat cable insulation in the whole zone where the cable conductor is deformed, with an inward radial deformation of the first hollow cylindrical member and with an outward radial deformation of the second hollow cylindrical member.

Other objects and advantages of the present invention will be apparent from the following detailed description of the presently preferred embodiments thereof, which description should be considered in conjunction with the accompanying drawings in which.

Figure 1:
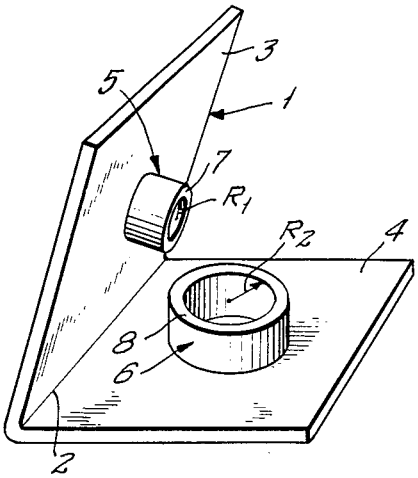
FIG. 1 is a perspective view of the connector according to the invention.

FIG. 1 illustrates an embodiment of a connector according to the invention. As shown in FIG. 1, a connector, according to the present invention, is constituted by a metal plate 1 which can be folded along an intermediate line 2 so as to provide a pair of arms, i.e., a first arm 3 and a second arm 4.

A first member 5, in the form of a hollow, cylindrical tube projects from the surface of the first arm 3 facing the second arm 4. A second member 6, in the form of a hollow, cylindrical tube projects from the surface of the second arm 4 facing toward the first arm 3. The hollow, cylindrical members 5 and 6 have their respective axes perpendicular to the surfaces of the arms from which they project. Preferably, the members 5 and 6 are integral with the respective arms 3 and 4 and may be formed, in any conventional manner, such as by the use of a punch and die.

The plate 1 and the members 5 and 6 may be made of any metal which is bendable and deformable in the manner hereinafter described. The plate 1 and the members 5 and 6 may, for example, be made of copper alloys and the thickness of the plate 1 and the walls of the members 5 and 6 may be, for example, in the range from 0.3 to 0.8 mm.

The first, hollow, cylindrical member 5 can be inserted into the second, hollow, cylindrical member 6 when the plate 1 has been folded along the line 2, i.e. after the mutual approaching of the surfaces facing each other of the first and second arms of the connector. Following the insertion of the first, hollow, cylindrical member 5 into the second, hollow, cylindrical member 6, said hollow, cylindrical members are coaxial.

The connector of the invention is to be distinguished from the connector disclosed in U.S. Pat. No. 4,256,359 in which a male die member extending from one arm cooperates with an opening in the other arm to punch out a portion of the cable insulation and conductor. In such connector, the cable conductor contacts the male die member only at the surface surrounding the male die member which is unsatisfactory. In order to provide such punching out of a portion of the cable conductor, the size of the male die member must be substantially the same as the size of the opening in the other arm whereas in the connector of the present invention, the size of the first and second members is so related that a portion of the cable conductor is not punched out. Instead, the cable conductor remains intact, although deformed, and the first and second members radially deform, in opposite directions, to scrape away the cable insulation and to form relatively large areas of conductive contact with the cable conductor.

In particular, the difference between the inner radius $R_2$ of the second, hollow, cylindrical member 6 and the outer radius $R_1$ of the first, hollow, cylindrical member 5 is not less than $\frac{1}{3}$ of the thickness of the conductor of the flat cable to be interposed between the first arm 3 and the second arm 4 of the connector 1. Typically, the conductor of the flat cable has a thickness in the range from 0.1 to 1.0 mm.

Further, both the distal end 7 of the first, hollow, cylindrical member 5, which is the end of this latter farthest from the surface of the first arm 3, and the distal end 8 of the second, hollow, cylindrical member 6, which is the end farthest from the surface of the second arm 5, lie in planes substantially parallel to the surfaces of the respective arms 3 and 4 so that when the ends 7 and 8 engage a cable they lie in substantially parallel planes which reduces or eliminates any tendency of the members 5 and 6 to cause piercing of the cable conductor. If desired, to assist in obtaining parallelism of the ends 7 and 8 as they approach the cable, the bend line 2 may be of a significant width, in a direction transverse to the length thereof so as to have, in effect, two parallel, spaced bend lines.

In the connector according to the invention shown in FIG. 1, the cylindrical members 5 and 6 projecting from the facing surfaces of the connector arms 3 and 4 have, in cross-section, a circular shape, but it is to be understood that other shapes could be used since said cylinders can have other cross-sectional shapes such, as for instance, an elliptic shape and the like, or even a polygonal shape.

In the case in which the cross-sections of the hollow, cylindrical members 5 and 6 are not circular, it is necessary to provide the condition for which the difference between the inner radial dimensions of the second, hollow, cylindrical member 6 and the outer radial dimensions of the first, hollow, cylindrical member be not less than $\frac{1}{3}$ of the thickness of the conductor of flat cable to be interposed between the first and the second arms 3 and 4 of the connector 1.

Figure 2:
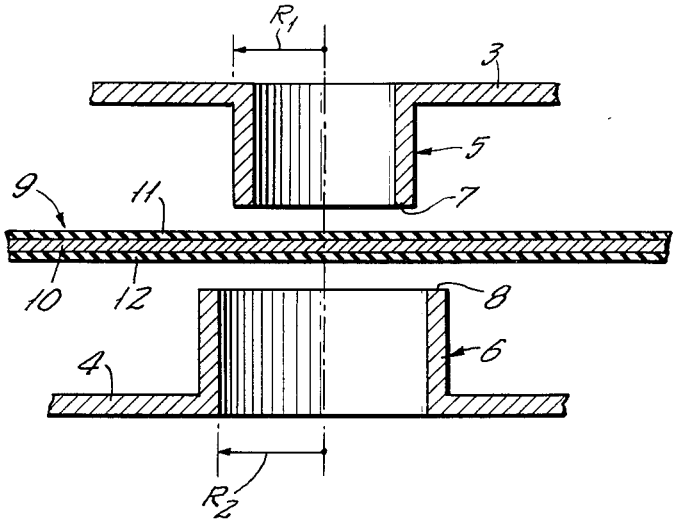
FIG. 2 is an enlarged, fragmentary, sectional view of the connector shown in FIG. 1, with the arms bent toward each other and with a cable therebetween.

FIG. 2 illustrates, in enlarged scale and in section, the details of the hollow, cylindrical members 5 and 6 of a connector, according to the invention, between which a flat cable 9 is interposed before the connection between the connector and the cable 9 is made.

As shown in FIG. 2, following the folding of the connector 1 along the line 2, which provides the formation of the first arm 3 and second arm 4, the hollow, cylindrical members 5 and 6 are opposed, one to the other, and a flat cable 9 is interposed between them.

In particular, the hollow, cylindrical members 5 and 6 are essentially coaxial with each other, and the flat cable 9 has a conductor 10, constituted by a metallic tape surrounded by an insulating covering, for instance, of plastic material, which form layers of insulating material 11 and 12 on the faces of the conductor 10.

An electrical connection with a flat cable is carried out by means of a connector, according to the present invention, previously described and said electrical connection also forms an object of the present invention.

For carrying out an electrical connection according to the present invention, a flat cable such as the cable 9, is interposed between the arms 3 and 4 of the connector 1 as shown in FIG. 2. The connector 1 may be provided with means, not shown, to be connected to another conductor, for instance, the conductor of a round cable, and since said means are known per se it will not be described herein. Reference is made to U.S. Pat. Nos. 3,247,316 and 3,138,658 as illustrating such means.

When a flat cable, such as the cable 9, has been inserted between the arms 3 and 4 of the connector 1, said arms are moved toward each other by a rotation of the arms themselves around the folding or bend line 2 of the metallic plate.

FIG. 2 represents the positions in which the hollow cylindrical members 5 and 6, belonging respectively to the arms 3 and 4 of the connector, are before the contact of said hollow, cylindrical members 5 and 6 with the flat cable 9. By continuing the rotation of the arms 3 and 4 around the line 2, the first, hollow, cylindrical member 5 and the second, hollow, cylindrical member 6 contact the flat cable 9. The cylindrical members 5 and 6, which are carried by the arms 3 and 4, upon contact with the flat cable 9 first penetrate, at their ends 7 and 8, into the layers of insulating material 11 and 12 present on the faces of the flat cable.

As the arms 3 and 4 of the connector are further pressed together, the hollow, cylindrical members 5 and 6 deform the flat cable (with the formation in said flat cable of a flat bottom embossing, i.e. an embossing with substantially flat bottom) scraping away and removing, during said deformation, the layers of insulating material 11 and 12 provided on the faces of the conductor of the flat cable.

Figure 3:
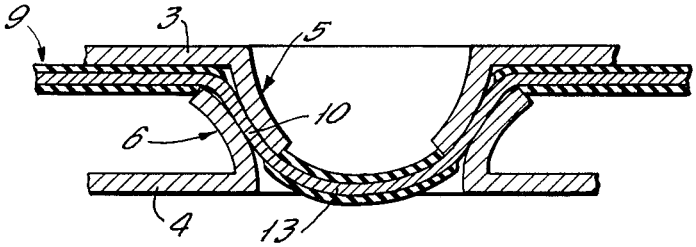
FIG. 3 is an enlarged, fragmentary, sectional view showing the shape and positions of the parts when the connection between the connector and the flat cable has taken place.

At the same time that the flat cable gets deformed, the hollow, cylindrical members 5 and 6 get deformed. In particular, the deformation of the hollow, cylindrical member 5 supported by the arm 3 of the connector, occurs in consequence of a progressive reduction in the transversal dimensions of the member 5 as illustrated in FIG. 3. The deformation of the hollow, cylindrical member 6, supported by the arm 4, takes place in the opposite direction, i.e. there is a progressive widening of the cylindrical member 6 as illustrated in FIG. 3.

FIG. 3 illustrates the positions of the hollow, cylindrical members 5 and 6, and the flat cable 9 interposed between them, when the connector has been secured to the cable 9 and the approaching of the arms 3 and 4 of the connector toward each other is completed.

As shown in FIG. 3, the flat cable 9 has a flat-bottom embossing 13 in the zone where it is in contact with the hollow, cylindrical members 5 and 6, and said hollow, cylindrical members 5 and 6 are deformed as shown. In fact, the hollow, cylindrical member 5 is deformed into the shape of a cup tapered toward the inside, whereas the hollow, cylindrical member 6 results is deformed into the shape of a cup tapered toward the outside.

The exterior surfaces of the walls of the hollow, cylindrical members 5 and 6 are almost completely in contact with the conductor 10 of the flat cable 9 since, during the contemporaneous deformation of the flat cable and the deformation of the hollow, cylindrical members 5 and 6, the layers of insulating material 11 and 12 have been removed from the portion of the conductor 10 which correspond to said exterior surfaces of said hollow, cylindrical members 5 and 6.

In the above described embodiment of a connector for cable according to the present invention and of the electrical connection, according to the present invention, the ends 7 and of the hollow, cylindrical members 5 and 6 farthest from their respective arms 3 and 4 are flat surfaces, each laying in a plane, as illustrated in FIG. 2.

Figure 4:
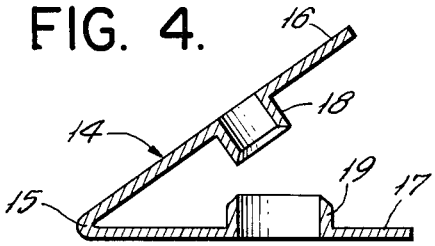
FIG. 4 is a sectional view of an alternative embodiment of a connector according to the invention.

However, preferably, the ends 7 and 8 of the hollow, cylindrical members 5 and 6, farthest from their respective arms and 4, are provided with a chamfering in the thickness of the material. In particular, it is preferable that a chamfering tapered toward the inside be present at the end 7 of the hollow, cylindrical member 5 and that a chamfering tapered toward the outside be present at the end 8 of the hollow, cylindrical member 6 as illustrated in FIG. 4. In this way, the operation of removing the insulating coverings 11 and 12 from the faces of the flat cable 9 is more efficacious.

FIG. 4 represents an alternative embodiment of a connector according to the present invention in which the connector is constituted by a metallic plate 14 which can be folded along a line 15 which defines the junction between a pair of arms 16 and 17.

A hollow, cylindrical member 18 is present on the surface of the arm 16 facing the arm 17 while a hollow, cylindrical member 19 is present on the face of the arm 17 facing the arm 16. The first hollow, cylindrical member 18 can be inserted into the second hollow, cylindrical member 19, and the relationship between the dimensions of the hollow, cylindrical members 18 and 19 are the same as those set forth in the description of the embodiment shown in FIG. 1.

The alternative embodiment of a connector according to the present invention illustrated in FIG. 4 also differs from that of FIG. 1 in the fact that the hollow, cylindrical member 18 has a height, with respect to the arm 16, greater than the height of the member 19 with respect to the arm 17, and in particular, the hollow cylindrical member 18, preferably, is higher than the hollow, cylindrical member 19 by an amount equal to the thickness of the cable conductor, such as the conductor 10. In the embodiment illustrated in FIGS. 1–3, the members 5 and 6 have the same height, but if desired, the member 5 may have a height which may be as small as 50% of the height of the member 6.

Figure 5:
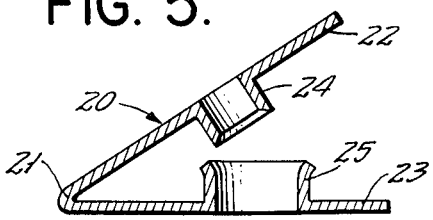
FIG. 5 is a sectional view of a further alternative embodiment of a connector according to the invention.

FIG. 5 illustrates a further alternative embodiment of a connector according to the present invention. As shown in FIG. 5, the connector 2 is constituted by a metallic plate 20 which can be folded along a line 21 which provides two arms 22 and 23.

A hollow, cylindrical member 24 projects from the surface of the arm 22 facing the arm 23, and a second hollow, cylindrical member 25 projects from the face of the arm 23 facing the arm 22. The hollow, cylindrical members 24 and 25 of the embodiment shown in FIG. 5 can be inserted one into the other and have the dimensional characteristics described in connection with the connector illustrated in FIG. 1.

The embodiment of a connector according to the present invention shown in FIG. 5 differs from the embodiment of FIG. 1 by the fact that the member 24 has a chamfered end and the member 25, which receives the hollow, cylindrical member 24 has its end, or portion farthest from the arm 23, flared toward the outside.

In all the previously described embodiments of a connector according to the present invention, the facing surfaces of the first and second arms of the connector, not occupied by the hollow cylindrical reliefs are smooth. According to alternative embodiments projecting tangs can be provided on the facing surfaces of the arms of the connectors. Said tangs are able to perforate only the insulation of the flat cable to improve still more the very good electrical contact obtained by the hollow, cylindrical members projecting from the arms with the conductor of the flat cable which is interposed between said arms and deformed.

Although only one hollow, cylindrical member, e.g. 5, 18 or 24, is shown on one arm of the connector and only one cooperating hollow, cylindrical member, e.g. 6, 19 or 25, has been shown on the other arm, it will be apparent to those skilled in the art that more than one pair of cooperating such members may be provided on the arms to provide more than one pair of members contacting the conductor of a cable or conductors of the same cable or of different cables.

From the previous description of some embodiments of connectors according to the present invention and of an electrical connection with a flat cable comprising a connector according to the present invention, it will be apparent that the objects of the invention have been attained.

In fact, with respect to presenting an encumbrance, this latter is a minimum since the deformation of the cylindrical members projecting from the arms of the connector, which occurs during the electrical connection, leads to a reduction in their height as said cylindrical members are inserted one into the other.

Also, the mechanical connection obtained between a connector according to the present invention and a flat cable is to be considered as very good in spite of the encumbrance reduction which can be obtained during the electrical connection since firstly, each hollow, cylindrical relief is coupled to the embossing which is formed in the flat cable and secondly, because through the deformations occurring contemporaneously on the hollow, cylindrical members of the connector and the flat cable, a close contact among these elements is obtained.

Lastly, also, the electrical connection which can be obtained between a connector according to the present invention and a flat cable is very good since the area of the surface where the contact between the hollow, cylindrical members, projecting from the arms of the connector, and the conductor of the flat cable takes place is an area substantially larger than the contact surface area when the contact takes place with connectors of the known type. Said electrical connection maintains itself very good over a long period of time since the hollow, cylindrical members, which have become deformed and which the conductor of the flat cable, maintain a pressure of contact against said conductor over a long period of time.

As used in the claims set forth hereinafter, the term "tubular member" refers to a hollow member of the type illustrated by the members 5, 6, 18, 19, 24 and 25 whether the cross-section thereof is circular, elliptical, polygonal or the like.

Although preferred embodiments of the present invention have been described and illustrated, it will be apparent to those skilled in the art that various modifications may be made without departing from the principles of the invention.

We claim:

1. A connector for a flat cable having a conductor, said connector comprising:

a bendable metal plate, said plate being bendable along a bending line to provide a first arm portion and a second arm portion extending from said bending line;

a first radially deformable tubular member of metal extending from the surface of said first arm portion which faces said second arm portion when said plate is bent, said first tubular member being disposed with its longitudinal axis substantially perpendicular to the plane of said surface and said first tubular member having a distal end surface which is engageable with said conductor with bending of said plate and having a wall thickness such that at least said distal end thereof is radially deformable inwardly upon engagement with said conductor and bending of said plate; and a second radially deformable tubular member of metal extending from the surface of said second arm portion which faces said first arm portion when said plate is bent, said second tubular member being disposed with its longitudinal axis substantially perpendicular to the plane of said surface of said second arm portion, said second tubular member having a bore of a size which is greater than the exterior size of said first tubular member by at least $\frac{1}{3}$ the thickness of said conductor and being disposed on said second arm portion to receive said first tubular member in said bore with the wall of said bore spaced radially from the exterior surface of said first tubular member when said plate is bent and said second tubular member having a distal end which is engageable with said conductor with bending of said plate and having a wall thickness such that at least said distal end thereof is radially deformable outwardly upon engagement with said conductor and bending of said plate;

whereby by bending said plate and causing said arm portions to move toward each other, the distal ends of said first and second tubular members engage said conductor and deform inwardly and outwardly, respectively, without penetrating through said conductor and the distal end of said first tubular member enters into said bore of said second tubular member.

2. A connector for a flat cable as set forth in claim 1 wherein said first tubular member has a peripheral surface at its distal end which lies substantially in a single first plane and said second tubular member has a peripheral surface at its distal end which lies substantially in a single second plane.

3. A connector for a flat cable as set forth in claim 2 wherein said single first plane is substantially parallel to the plane of said surface of said first arm portion.

4. A connector for a flat cable as set forth in claim 3 wherein said single second plane is substantially parallel to the plane of said surface of said second arm portion.

5. A connector for a flat cable as set forth in claim 1 wherein the height of said first tubular member above said surface of said first arm portion is at least equal to one-half the height of said second tubular member above said surface of said second arm portion.

6. A connector for a flat cable as set forth in claim 5 wherein said height of said first tubular member is greater than said height of said second tubular member.

7. A connector for a flat cable as set forth in claim 1 wherein each of said first tubular member and said second, tubular member has the cross-section of a hollow cylinder.

8. A connector for a flat cable as set forth in claim 7 wherein the inner diameter of said second tubular member is greater than the outer diameter of said first tubular member by at least 0.1 millimeter.

9. A connector for a flat cable as set forth in claim 8 wherein the wall thicknesses of said first and second tubular members is in the range from about 0.3 millimeter to about 0.8 millimeter.

10. A connector for a flat cable as set forth in claim 1 wherein said distal end of said second tubular member is flared outwardly.

11. A connector for a flat cable as set forth in claim 1 wherein said distal end of said second tubular member is chamfered toward the outside.

12. A connector for a flat cable as set forth in claim 11 wherein said distal end surface of said first tubular member is chamfered toward the inside.

13. In combination, a flat cable comprising at least one flat conductor having insulation on the surfaces thereof and a connector mechanically secured and electrically connected to said cable, said connector comprising:

a metal plate bent intermediate its ends to provide a first arm portion and a second arm portion and disposed with said cable between said first arm portion and said second arm portion;

a first tubular member extending from said first arm portion and through said insulation into conductive contact with said conductor without passing therethrough, at least the distal end of said first, tubular member being tapered and having a reduced radius as compared to the opposite end thereof at said first arm portion and said distal end deforming said conductor with respect to portions of said conductor outside said first tubular member;

a second tubular member extending from said second arm portion and through said insulation into conductive contact with said conductor without passing therethrough, at least a portion of said second tubular member encircling at least a portion of said first tubular member and at least the distal end of said second tubular member being flared outwardly as compared to the opposite end thereof at said second arm portion; and said insulation being removed from said conductor at the tapered portion of said first tubular member and at the flared portion of said second tubular member to provide conductive contact between said conductor, on the one hand, and said tapered portion and said flared portion, on the other hand.

14. The combination as set forth in claim 13 wherein the portion of said conductor from which the insulation is removed is clamped between said tapered portion and said flared portion.

15. A connector as set forth in claim 1 wherein the height of said first radially deformable tubular member above the surface from which it extends plus the height of said second radially deformable tubular member above the surface from which it extends is greater than the distance between said surface of said first arm portion and said surface of said second arm portion when said plate is bent so that said surface of said first arm portion is substantially parallel to said surface of said second arm portion.

* * * * *

UNITED STATES PATENT AND TRADEMARK OFFICE

CERTIFICATE OF CORRECTION

PATENT NO. : 4,560,225

DATED : December 24, 1985

INVENTOR(S) : Margaroli et al

It is certified that error appears in the above-identified patent and that said Letters Patent is hereby corrected as shown below:

Column 6, line 65, after "and" insert --8--.

Column 7, line 3, before "and" insert --3--.

Signed and Sealed this

*Twenty-ninth* Day of *April 1986*

[SEAL]

*Attest:*

DONALD J. QUIGG

*Attesting Officer* *Commissioner of Patents and Trademarks*